US010991567B2

(12) United States Patent
Langridge et al.

(10) Patent No.: US 10,991,567 B2
(45) Date of Patent: Apr. 27, 2021

(54) QUADRUPOLE DEVICES

(71) Applicant: MICROMASS UK LIMITED, Wilmslow (GB)

(72) Inventors: David J. Langridge, Macclesfield (GB); Martin Raymond Green, Bowdon (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 16/330,713

(22) PCT Filed: Sep. 6, 2017

(86) PCT No.: PCT/GB2017/052586
§ 371 (c)(1),
(2) Date: Mar. 5, 2019

(87) PCT Pub. No.: WO2018/046905
PCT Pub. Date: Mar. 15, 2018

(65) Prior Publication Data

US 2020/0203142 A1 Jun. 25, 2020

(30) Foreign Application Priority Data

Sep. 6, 2016 (GB) ..... 1615132.6

(51) Int. Cl.
*H01J 49/42* (2006.01)
*H01J 49/06* (2006.01)

(52) U.S. Cl.
CPC ..... *H01J 49/4225* (2013.01); *H01J 49/065* (2013.01); *H01J 49/429* (2013.01)

(58) Field of Classification Search
CPC ..... H01J 49/4225; H01J 49/065; H01J 49/429
See application file for complete search history.

(56) References Cited

U.S. PATENT DOCUMENTS

2004/0021072 A1 2/2004 Soudakov et al.
2007/0158545 A1 7/2007 Verentchikov
2008/0035841 A1 2/2008 Ding
(Continued)

FOREIGN PATENT DOCUMENTS

CN 1653582 8/2005
EP 2136389 A1 12/2009

OTHER PUBLICATIONS

Search Report under Section 17(5) for GB Application No. GB1615132.6 dated Feb. 1, 2017, 6 pages.
(Continued)

*Primary Examiner* — Nicole M Ippolito
*Assistant Examiner* — Hanway Chang
(74) *Attorney, Agent, or Firm* — Kacvinsky Daisak Bluni PLLC

(57) ABSTRACT

A method of operating a quadrupole device is disclosed that comprises operating the quadrupole device in a first mode of operation, passing ions into the quadrupole device while the quadrupole device is operated in the first mode of operation, and then operating the quadrupole device in a second mode of operation. Operating the quadrupole device in the second mode of operation comprises applying one or more drive voltages to the quadrupole device, and operating the quadrupole device in the first mode of operation comprises applying one or more reduced drive voltages or not applying one or more drive voltages to the quadrupole device.

14 Claims, 8 Drawing Sheets

(56) References Cited

U.S. PATENT DOCUMENTS

| | | | |
|---|---|---|---|
| 2008/0277580 | A1 | 11/2008 | Takeshita et al. |
| 2010/0116982 | A1 | 5/2010 | Iwamoto et al. |
| 2012/0119083 | A1 | 5/2012 | Kodera et al. |
| 2012/0292499 | A1 | 11/2012 | Taniguchi |
| 2015/0214019 | A1 | 7/2015 | Makarov et al. |

OTHER PUBLICATIONS

Combined Search and Examination Report under Sections 17 & 18(3) for GB Application No. GB1714276.1 dated Feb. 28, 2018, 8 pages.

International Search Report and Written Opinion for International Application No. PCT/GB2017/052586 dated Nov. 22, 2017, 12 pages.

Communication purusant to Article 94(3) EPC, for Application No. 17767876.0, dated Nov. 12, 2020, 8 pages.

QUADRUPOLE DEVICES

CROSS-REFERENCE TO RELATED APPLICATION

This application is a national phase filing claiming the benefit of and priority to International Patent Application No. PCT/GB2017/052586, filed on Sep. 6, 2017, which claims priority from and the benefit of United Kingdom patent application No. 1615132.6 filed on Sep. 6, 2016. The entire contents of these applications are incorporated herein by reference.

FIELD OF THE INVENTION

The present invention relates generally to quadrupole devices and analytical instruments such as mass and/or ion mobility spectrometers that comprise quadrupole devices, and in particular to quadrupole mass filters and analytical instruments that comprise quadrupole mass filters.

BACKGROUND

Quadrupole mass filters are well known and comprise four parallel rod electrodes. FIG. 1 shows a typical arrangement of a quadrupole mass filter.

In conventional operation, one or more RF voltages and optionally one or more DC voltages are applied to the rod electrodes of the quadrupole so that the quadrupole operates in a mass or mass to charge ratio resolving mode of operation. Ions having mass to charge ratios within a desired mass to charge ratio range will be onwardly transmitted by the mass filter, but undesired ions having mass to charge ratio values outside of the mass to charge ratio range will be substantially attenuated.

The application of the voltages to the finite-length rod electrodes results in the production of so-called "fringing fields" at the entrance (and exit) of the quadrupole rod set. Ions must transit across the fringing fields at the entrance of the quadrupole rod set in order to enter the quadrupole mass filter.

When a quadrupole mass filter is operated near the tip of the first stability region (or in any higher stability regions), ions are not stable in the fringing field region. This can lead to greatly reduced transmission of ions through the mass filter.

Various approaches to solve this problem have been proposed, such as the use of Brubaker lenses, phased locked RF lenses, and high energy injection.

Brubaker lenses can be an effective solution when a quadrupole mass filter is operated at the tip of the first stability region. However, for higher stability regions there is no continuously stable path across the stability diagram, and so they cannot be used for operation in higher stability regions.

Phase locked RF lenses attempt to modulate the input ion conditions to better match the acceptance ellipse as it changes across the phases of the RF cycle. However, while they attempt to increase the transmission through a quadrupole mass filter, they do not directly address the issue of fringing fields.

High energy injection techniques attempt to increase transmission by reducing the number of RF cycles ions spend in the fringing field region. However, this approach is disadvantageous as it reduces the number of RF cycles seen by the ions within the quadrupole mass filter itself, leading to reduced resolution.

It is desired to provide an improved quadrupole device.

SUMMARY

According to an aspect, there is provided a method of operating a quadrupole device comprising:

operating the quadrupole device in a first mode of operation;

passing ions into the quadrupole device while the quadrupole device is operated in the first mode of operation; and then operating the quadrupole device in a second mode of operation;

wherein operating the quadrupole device in the second mode of operation comprises applying one or more drive voltages to the quadrupole device; and wherein operating the quadrupole device in the first mode of operation comprises applying one or more reduced drive voltages or not applying one or more drive voltages to the quadrupole device.

Various embodiments described herein are directed to methods of operating a quadrupole device, such as a quadrupole mass filter or a linear ion trap ("LIT"), in which ions are introduced into the quadrupole device when one or more reduced drive voltages are applied to the electrodes of the quadrupole device or a drive voltage is not applied (is other than applied) to the electrodes of the quadrupole device. By not applying drive voltages to the quadrupole device or by applying one or more reduced drive voltages, the ions may enter the quadrupole without experiencing a fringe field or while experiencing a reduced fringe field.

According to various embodiments, once the ions have been passed into the quadrupole device, then one or more drive voltages may be applied to the electrodes of the quadrupole device. Where the quadrupole device comprises a quadrupole mass filter, the one or more drive voltages may be applied to the quadrupole mass filter such that ions are selected and/or filtered according to their mass to charge ratio. Where the quadrupole device comprises a linear ion trap, the one or more drive voltages may be applied to the linear ion trap such that ions are confined within the linear ion trap. This may be done after at least some or all of the ions have travelled a sufficient axial distance into the quadrupole, e.g. such that the electric field experienced by the ions is substantially identical to a quadrupolar electric field, i.e. such that fringing field effects are negligible.

Accordingly, the transmission of ions through the quadrupole device can be improved, e.g. without the use of Brubaker lenses, phased locked RF lenses, or high energy injection techniques.

It will be appreciated, therefore, that the present invention provides an improved quadrupole device.

Passing ions into the quadrupole device may comprise passing one or more packets of ions into the quadrupole device.

The one or more drive voltages may comprise one or more digital drive voltages.

The one or more drive voltages may comprise a repeating (RF) voltage waveform.

The method may comprise operating the quadrupole device such that the ions initially experience a selected phase or range of phases of the voltage waveform in the quadrupole device and/or in the second mode of operation.

Operating the quadrupole device in the second mode of operation may comprise initially applying the one or more drive voltages to the quadrupole device at a selected phase or range of phases of the voltage waveform.

The voltage waveform may be configured to have at least some phase values at which the drive voltage is zero.

The selected phase or range of phases may at least partially coincide with the at least some phase values at which the drive voltage is zero.

The selected phase or range of phases may be or may be close to an optimal phase or range of phases such that the maximum amplitude of ion oscillation is reduced or minimised.

The method may comprise increasing the radial positions of at least some of the ions and/or reducing the radial velocities of at least some of the ions before passing the ions into the quadrupole device.

The method may comprise decreasing the radial positions of at least some of the ions and/or increasing the radial velocities of at least some of the ions before passing the ions into the quadrupole device.

The quadrupole device may comprise a quadrupole mass filter, and operating the quadrupole device in the second mode of operation may comprise applying one or more drive voltages to the quadrupole mass filter such that ions are selected and/or filtered according to their mass to charge ratio.

The quadrupole device may comprise a linear ion trap, and operating the quadrupole device in the second mode of operation may comprise applying one or more drive voltages to the linear ion trap such that ions are radially confined within the linear ion trap.

Operating the quadrupole device in the first mode of operation may comprise applying a zero drive voltage or not applying a drive voltage to the quadrupole device.

The one or more drive voltages may comprise one or more quadrupolar repeating voltage waveforms, optionally together with one or more dipolar repeating voltage waveforms.

According to an aspect, there is provided apparatus comprising:

a quadrupole device; and a control system;

wherein the control system is configured:

(i) to operate the quadrupole device in a first mode of operation;

(ii) to cause ions to be passed into the quadrupole device while the quadrupole device is operated in the first mode of operation; and then (iii) to operate the quadrupole device in a second mode of operation;

wherein the control system is configured to operate the quadrupole device in the second mode of operation by applying one or more drive voltages to the quadrupole device; and wherein the control system is configured to operate the quadrupole device in the first mode of operation by applying one or more reduced drive voltages or by not applying (by other than applying) one or more drive voltages to the quadrupole device.

The apparatus may comprise an ion trap or trapping region.

The control system may be configured to cause one or more packets of ions to be passed from the ion trap or trapping region into the quadrupole device.

The one or more drive voltages may comprise one or more digital drive voltages.

The one or more drive voltages may comprise a repeating (RF) voltage waveform.

The control system may be configured to operate the quadrupole device such that the ions initially experience a selected phase or range of phases of the voltage waveform in the quadrupole device and/or in the second mode of operation.

The control system may be configured to operate the quadrupole device in the second mode of operation by initially applying the one or more drive voltages to the quadrupole device at a selected phase or range of phases of the voltage waveform.

The voltage waveform may be configured to have at least some phase values at which the drive voltage is zero.

The selected phase or range of phases may at least partially coincide with the at least some phase values at which the drive voltage is zero.

The selected phase or range of phases may be or may be close to an optimal phase or range of phases such that the maximum amplitude of ion oscillation is reduced or minimised.

The apparatus may comprise one or more ion optical components configured to increase the radial positions of at least some of the ions and/or reduce the radial velocities of at least some of the ions.

The apparatus may comprise one or more ion optical components configured to decrease the radial positions of at least some of the ions and/or increase the radial velocities of at least some of the ions before passing the ions into the quadrupole device.

The quadrupole device may comprise a quadrupole mass filter, and the control system may be configured to operate the quadrupole device in the second mode of operation by applying one or more drive voltages to the quadrupole mass filter such that ions are selected and/or filtered according to their mass to charge ratio.

The quadrupole device may comprise a linear ion trap, and the control system may be configured to operate the quadrupole device in the second mode of operation by applying one or more drive voltages to the linear ion trap such that ions are radially confined within the linear ion trap.

The control system may be configured to operate the quadrupole device in the first mode of operation by applying a zero drive voltage or not applying a drive voltage to the quadrupole device.

The one or more drive voltages may comprise one or more quadrupolar repeating voltage waveforms, optionally together with one or more dipolar repeating voltage waveforms.

According to an aspect, there is provided a method of operating a quadrupole mass filter comprising:

operating the quadrupole mass filter in a first mode of operation;

passing ions into the quadrupole mass filter while the quadrupole mass filter is operated in the first mode of operation; and then operating the quadrupole mass filter in a second mode of operation;

wherein operating the quadrupole mass filter in the second mode of operation comprises applying one or more drive voltages to the quadrupole mass filter; and wherein operating the quadrupole mass filter in the first mode of operation comprises applying one or more reduced drive voltages or not applying one or more drive voltages to the quadrupole mass filter.

According to an aspect, there is provided apparatus comprising:

a quadrupole mass filter; and a control system;

wherein the control system is configured:

(i) to operate the quadrupole mass filter in a first mode of operation;

(ii) to cause ions to be passed into the quadrupole mass filter while the quadrupole mass filter is operated in the first mode of operation; and then (iii) to operate the quadrupole mass filter in a second mode of operation;

wherein the control system is configured to operate the quadrupole mass filter in the second mode of operation by applying one or more drive voltages to the quadrupole mass filter; and wherein the control system is configured to operate the quadrupole mass filter in the first mode of operation by applying one or more reduced drive voltages or by not applying (by other than applying) one or more drive voltages to the quadrupole mass filter.

According to an aspect, there is provided a method of operating a linear ion trap comprising:

operating the linear ion trap in a first mode of operation;

passing ions into the linear ion trap while the linear ion trap is operated in the first mode of operation; and then operating the linear ion trap in a second mode of operation;

wherein operating the linear ion trap in the second mode of operation comprises applying one or more drive voltages to the linear ion trap; and wherein operating the linear ion trap in the first mode of operation comprises applying one or more reduced drive voltages or not applying one or more drive voltages to the linear ion trap.

According to an aspect, there is provided apparatus comprising:

a linear ion trap; and a control system;

wherein the control system is configured:

(i) to operate the linear ion trap in a first mode of operation;

(ii) to cause ions to be passed into the linear ion trap while the linear ion trap is operated in the first mode of operation; and then (iii) to operate the linear ion trap in a second mode of operation;

wherein the control system is configured to operate the linear ion trap in the second mode of operation by applying one or more drive voltages to the linear ion trap; and wherein the control system is configured to operate the linear ion trap in the first mode of operation by applying one or more reduced drive voltages or by not applying (by other than applying) one or more drive voltages to the linear ion trap.

According to an aspect, there is provided a quadrupole mass filter comprising:

a quadrupole mass filter with a digitally driven RF; and an ion trapping region upstream of the quadrupole mass filter;

wherein in operation:

the digital drive voltage applied to the quadrupole mass filter is turned off;

ions are released in a packet from the trapping region into the quadrupole mass filter;

after some delay time the digital drive voltage is applied to the quadrupole mass filter;

once all the ions of the mass to charge ratio ("m/z") of interest have passed through the quadrupole mass filter the digital drive voltage is returned to the off state ready for another packet; and ions are accumulated in the trapping region between packet releases.

The drive voltage may be applied at a specific initial phase or range of phases.

The packet of ions may be injected into the quadrupole mass filter with a minimal radial (x and/or y axis) velocity.

The drive voltage may be applied at an initial phase that corresponds to an optimum in the inverse amplitude phase characteristic of the first kind ("iAPC1") of the waveform and/or stability working point location chosen.

The RF waveform may be chosen such that the waveform has at least one period in the RF cycle where the applied voltage is zero.

The working point in the stability region may be chosen such that the optimal phase of the APC1 lies in this period.

Ion optical elements may be arranged between the trapping region and the quadrupole mass filter to deliberately enlarge the radial positional extent of the ion packet with a corresponding reduction in the radial velocity components.

The packet of ions may be injected such that at the point of application of the drive voltage the ion packet has minimal radial positional extent (in the x and/or y axes).

The drive voltage may be applied at an initial phase that corresponds to a minima in the amplitude phase characteristic of the second kind ("APC2") of the waveform and/or stability working point location chosen.

According to various embodiments, a packet of ions is injected into a quadrupole mass filter while the quadrupole drive voltage is turned off. This allows the ion packet to transit across the fringing field region in a field-free state.

Once the packet is at a sufficient axial distance into the quadrupole rod set the drive voltages may then be applied, e.g. with whatever initial phase is desired.

According to various embodiments, the sufficient axial distance is such that the field is substantially identical to the 2D quadrupolar field, i.e. ions are far enough from the entrance of the quadrupole that fringing field effects are negligible.

Use of a digital drive voltage according to various embodiments makes the initiation of the drive voltage relatively simple and straightforward.

The digital drive voltage can be used to reproduce whatever waveform is desired, and is not necessarily limited to e.g. rectangular waveforms.

According to an aspect there is provided an analytical instrument comprising a quadrupole device, such as a quadrupole mass filter or a linear ion trap, as described above.

The analytical instrument may comprise a mass and/or ion mobility spectrometer.

The spectrometer may comprise an ion source. The ion source may be selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells. The one or more collision, fragmentation or reaction cells may be selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The spectrometer may comprise one or more mass analysers. The one or more mass analysers may be selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

A chromatography detector may be provided, wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Various embodiments are directed to a method of operating a quadrupole mass filter.

Figure 1:
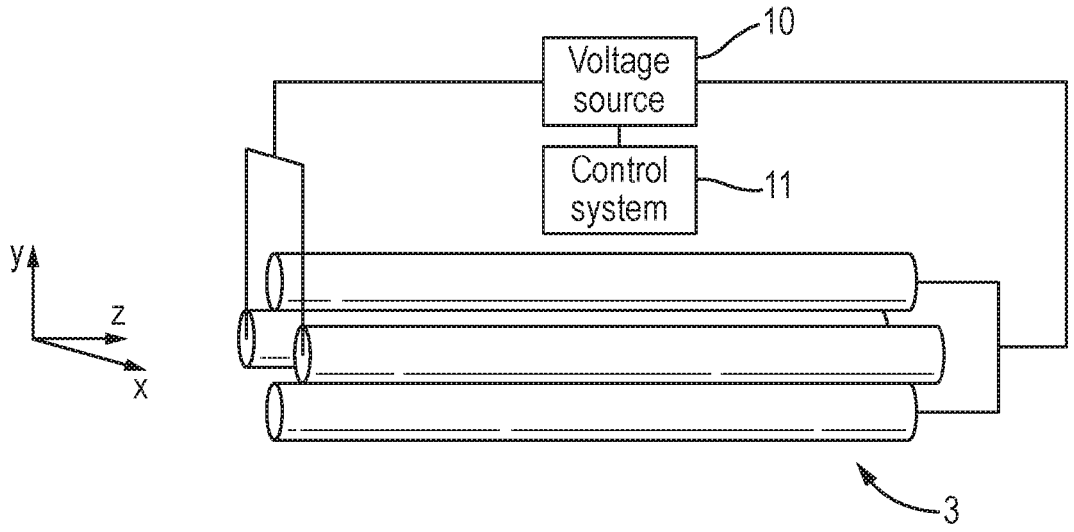
FIG. 1 shows schematically a quadrupole mass filter in accordance with various embodiments.

As illustrated in FIG. 1, the quadrupole mass filter 3 may comprise four electrodes, e.g. rod electrodes, which may be arranged parallel to one another. The rod electrodes may be arranged so as to surround a central axis of the quadrupole (z-axis) and parallel to the axis (parallel to the axial- or z-direction).

According to various embodiments, the quadrupole mass filter is operated in a first mode of operation, e.g. during a first period of time, and then operated in a second, different, mode of operation, e.g. during a second period of time.

In the second mode of operation, one or more drive voltages are applied to the electrodes of the quadrupole mass filter, e.g. by a voltage source 10, such that ions within the quadrupole are selected and/or filtered according to their mass to charge ratio. That is, the quadrupole is operated in a mass resolving mode of operation, where ions having mass to charge ratios within a desired mass to charge ratio range are onwardly transmitted by the mass filter, but undesired ions having mass to charge ratio values outside of the mass to charge ratio range will be substantially attenuated. Ions which are not desired to be onwardly transmitted by the mass filter are attenuated by causing the ions to assume unstable trajectories in the quadrupole.

The one or more drive voltages may comprise any suitable drive voltage(s) that will have the effect of causing at least some ions to be retained (e.g. radially or otherwise confined) within the quadrupole device. The one or more drive voltages may have the effect of causing ions within the quadrupole to be selected and/or filtered according to their mass to charge ratio. The drive voltage may comprise a repeating voltage waveform, and may be applied to any one or more of the electrodes of the quadrupole mass filter in any suitable manner.

The repeating voltage waveform may comprise an RF voltage optionally together with a DC offset voltage. Alternatively, the repeating voltage waveform may comprise a square or rectangular waveform. It would also be possible for the repeating voltage waveform to comprise a pulsed EC waveform, a three phase rectangular waveform, a triangular waveform, a sawtooth waveform, a trapezoidal waveform, and the like.

As shown in FIG. 1, each pair of opposing electrodes may be electrically connected and/or may be provided with the same drive voltage(s). A first phase of the voltage waveform may be applied to one of the pairs of opposing electrodes, and the opposite phase of the voltage waveform (180° out of phase) may be applied to the other pair of electrodes. Alternatively, the voltage waveform may be applied to only one of the pairs of opposing electrodes. The amplitude and/or frequency of the voltage waveform may be selected as desired.

In various embodiments, the quadrupole mass filter may be operated in a constant mass resolving mode of operation in the second mode of operation, i.e. ions having a single mass to charge ratio or single mass to charge ratio range may be selected and onwardly transmitted by the mass filter.

Alternatively, the quadrupole mass filter may be operated in a varying mass resolving mode of operation in the second mode of operation, i.e. ions having more than one particular mass to charge ratios or more than one mass to charge ratio ranges may be selected and onwardly transmitted by the mass filter. For example, the quadrupole may scanned, e.g. so as to sequentially select and transmit ions having different mass to charge ratios or mass to charge ratio ranges.

In the first mode of operation one or more reduced drive voltages are applied, a zero drive voltage is applied or drive voltages are not applied to the electrodes of the quadrupole mass filter. That is, the one or more drive voltages applied in the second mode of operation (i.e. the repeating voltage waveform) may be reduced (i.e. in amplitude and/or magnitude) or removed from the electrodes (i.e. turned off). Accordingly, the quadrupole may be operated in the first mode of operation in a reduced resolution mass resolving or non-mass resolving mode of operation.

In embodiments where the one or more drive voltages are reduced, the degree to which the one or more drive voltages are reduced may be selected as desired. For example, the (amplitude and/or magnitude of the) one or more drive voltages may be reduced by at least 50%, at least 60%, at least 70%, at least 80%, at least 90%, at least 95%, and/or at least 99%.

The one or more drive voltages may be reduced such that ions entering the quadrupole will experience a substantially reduced fringe field. For example, the one or more drive voltages may be reduced such that ions entering the quadrupole will experience a fringe field that is reduced (in amplitude and/or magnitude) by at least 50%, at least 60%, at least 70%, at least 80%, at least 90%, at least 95%, and/or at least 99%. Accordingly, the transmission of ions into (and therefore through) the quadrupole mass filter is increased.

In embodiments where the one or more drive voltages are not applied (are other than applied) (i.e. are removed or turned off, e.g. the (amplitude and/or magnitude of the) one or more drive voltages is reduced by around 100%), this is done such that ions entering the quadrupole may do so without experiencing a fringe field, i.e. such that the fringe field that is reduced by around 100%. Ions may transit the fringe field region at the entrance to the quadrupole mass filter in a field free state. Accordingly, the transmission of ions into (and therefore through) the quadrupole mass filter is increased.

Ions are passed into the quadrupole mass filter during the first period of time, i.e. while the one or more drive voltages are reduced, removed or turned off. Ions may be passed into the quadrupole, e.g. by pulsing them into the quadrupole, e.g. by using a pulsed electric field or otherwise. Accordingly, at least some or all of the ions that are passed into the quadrupole during the first period of time will experience a substantially reduced fringe field or may enter the quadrupole without experiencing a fringe field.

Accordingly, the transmission of ions through the mass filter can be improved, e.g. without the use of Brubaker lenses, phased locked RF lenses, or high energy injection techniques.

Once ions have been passed into the quadrupole mass filter, then the quadrupole may be switched to operate in the second mode of operation, i.e. the one or more drive voltages may be applied to the electrodes of the quadrupole mass filter, i.e. so as to select and/or filter ions according to their mass to charge ratio. Thus, according to various embodiments, the second period of time may immediately follow the first period of time.

The first period of time during which the quadrupole is operated in the first mode of operation may have any suitable duration. The first period of time may be long enough to allow the ions to travel a certain (selected) axial distance (e.g. measured from the entrance of the quadrupole) into the mass filter. The certain distance may be selected such that when the quadrupole is switched to operate in the second mode of operation, the electric field experienced by at least some or all of the ions is substantially identical to a quadrupolar electric field, i.e. ions may be far enough from the entrance of the quadrupole such that fringing field effects are negligible. In various embodiments, the certain distance may be of the order of mm or tens of mm.

The time delay between passing or releasing the ions into the quadrupole and switching the quadrupole to operate in the second mode of operation (the duration of the first period of time) may be selected as desired. In various embodiments, the time delay may be of the order of μs, tens of μs, hundreds of μs or thousands of μs.

The second period of time during which the quadrupole is operated in the second mode of operation may have any suitable duration. The second period of time may be long enough to allow at least some or all of the ions (e.g. packet of ions), or at least some or all ions of interest (e.g. ions having a mass to charge ratio ("m/z") range of interest) to pass through (and to be selected and/or filtered by) the quadrupole.

Once at least some of all of the ions (e.g. packet of ions), or at least some or all ions of interest (e.g. ions having a mass to charge ratio ("m/z") range of interest) have passed through the quadrupole (i.e. have exited the quadrupole), then the quadrupole may be switched back to the first mode of operation, i.e. the drive voltage(s) may be reduced, removed or turned off.

More ions, e.g. a further packet of ions, may then be introduced into the quadrupole, i.e. while experiencing a reduced fringe field or without experiencing a fringe field.

This operation may be repeated multiple times, i.e. the quadrupole may be switched multiple times between the first and second modes of operation, and ions may be passed into the quadrupole during some or each of the time periods during which the quadrupole is operated in the first mode of operation.

Thus, according to various embodiments, the method comprises operating the quadrupole device in the second mode of operation, and then operating the quadrupole device in the first mode of operation, and then operating the quadrupole device in the second mode of operation (and so on).

The ions that are passed into the quadrupole when the quadrupole is operated in the first mode of operation may comprise (part of) a beam of ions, e.g. a substantially continuous beam of ions that may e.g. be generated by an ion source or otherwise. In this case, ions of the ion beam that are passed to the quadrupole when the quadrupole is operated in the second mode of operation will experience a relatively low transmission into (and through) the quadrupole, but ions that are passed to the quadrupole when the quadrupole is operated in the first mode of operation will experience a relatively high transmission into (and through) the quadrupole. Accordingly, in these embodiments the overall transmission of ions through the quadrupole is increased.

In these embodiments, the switching of the quadrupole between the first and second modes of operation may be controlled in dependence on the composition of the ion beam. For example, if it is known or expected that ions of interest will be present in the ion beam during a particular period of time, then the quadrupole may be operated in the first (high transmission) mode of operation when the ions of interest are passed into the quadrupole.

According to various other embodiments, the ions that are passed into the quadrupole when the quadrupole is operated in the first mode of operation may comprise one or more packets or discrete groups of ions. In this case, each packet of ions may be passed into the quadruple when the quadrupole is operated in the first (high transmission) mode of operation, i.e. during a or the first period of time. This may increase duty cycle, e.g. since the quadrupole may be operated such that at least some or each packet of ions is substantially unaffected by or experiences reduced fringing fields. For example, ions may (always) be passed into the quadrupole when the one or more drive voltages are reduced, removed or turned off, i.e. so that the ions experience a substantially reduced fringe field or enter the quadrupole without experiencing a fringe field.

In these embodiments, a packet of ions may be accumulated or trapped, e.g. from a beam of ions or otherwise, and then the packet of ions may be passed into the quadrupole when the quadrupole is operated in the first mode of operation.

The ions may be accumulated in an ion trap or other accumulation or trapping region. Accordingly, in various embodiments an ion trap or trapping region may be provided, e.g. upstream of the quadrupole mass filter. A packet of ions may be released from the ion trap or trapping region when the quadrupole is operated in the first mode of operation, i.e. when the one or more drive voltages are reduced, removed or turned off. Accordingly, a packet of ions may be passed into the quadrupole such that the ions experience a substantially reduced fringe field or may enter the quadrupole without experiencing a fringe field.

In these embodiments, ions may be accumulated in the ion trap or trapping region when the quadrupole is operated in the second mode of operation (during the second period of time), i.e. while another packet of ions is being separated and/or filtered by the quadrupole. Where the quadrupole is switched between the first and second modes of operation multiple times, then during each time period when the quadrupole is operated in the second mode of operation, ions may be accumulated or trapped, and then each accumulated packet of ions may be passed into the quadrupole during each subsequent time period in which the quadrupole is operated in the first mode of operation. This has the effect of increasing duty cycle.

According to various embodiments, the one or more drive voltages are digitally applied, that is, the one or more drive voltages may comprise one or more digital drive voltages, and the voltage source 10 may comprise a digital voltage source. The digital voltage source may be configured to supply the one or more drive voltages to the electrodes of the quadrupole mass filter. As will be described in more detail below, the use of a digital drive voltage according to various embodiments facilitates increased flexibility in the operation of the quadrupole, and e.g. facilitates precise control over the initiation of the one or more drive voltages.

As shown in FIG. 1, according to various embodiments, a control system 11 may be provided. The voltage source 10 may be controlled by the control system 11 and/or may form part of the control system 11. The control system may be configured to control the operation of the quadrupole 3 and/or voltage source 10, e.g. in the manner of the various embodiments described herein. The control system 10 may comprise suitable control circuitry that is configured to cause the quadrupole 3 and/or voltage source 10 to operate in the manner of the various embodiments described herein. The control system may also comprise suitable processing circuitry configured to perform any one or more or all of the necessary processing and/or post-processing operations in respect of the various embodiments described herein.

It will be appreciated that various embodiments are directed to a method of pulsed injection of ions into a quadrupole mass filter with the drive voltage at zero.

According to various embodiments, a packet of ions is injected into a quadrupole mass filter while the quadrupole drive voltage is turned off. This allows the ion packet to transit across the fringing field region in a field-free state.

Once the packet is at a sufficient axial distance into the quadrupole rod set, the drive voltages may then be applied, e.g. with whatever initial phase is desired. According to various embodiments, the sufficient axial distance is such that the field experienced by the ions is substantially identical to the 2D quadrupolar field, i.e. ions are far enough from the entrance of the quadrupole that fringing field effects are negligible.

Use of a digital drive voltage according to various embodiments makes the initiation of the drive voltage relatively simple and straightforward. The digital drive voltage can be used to reproduce whatever waveform is desired, and is not necessarily limited e.g. to rectangular waveforms.

According to various embodiments, fringing field effects are avoided when ions are injected into the quadrupole mass filter. This can be used to provide improved resolution and transmission for the quadrupole mass filter.

Figure 2A:
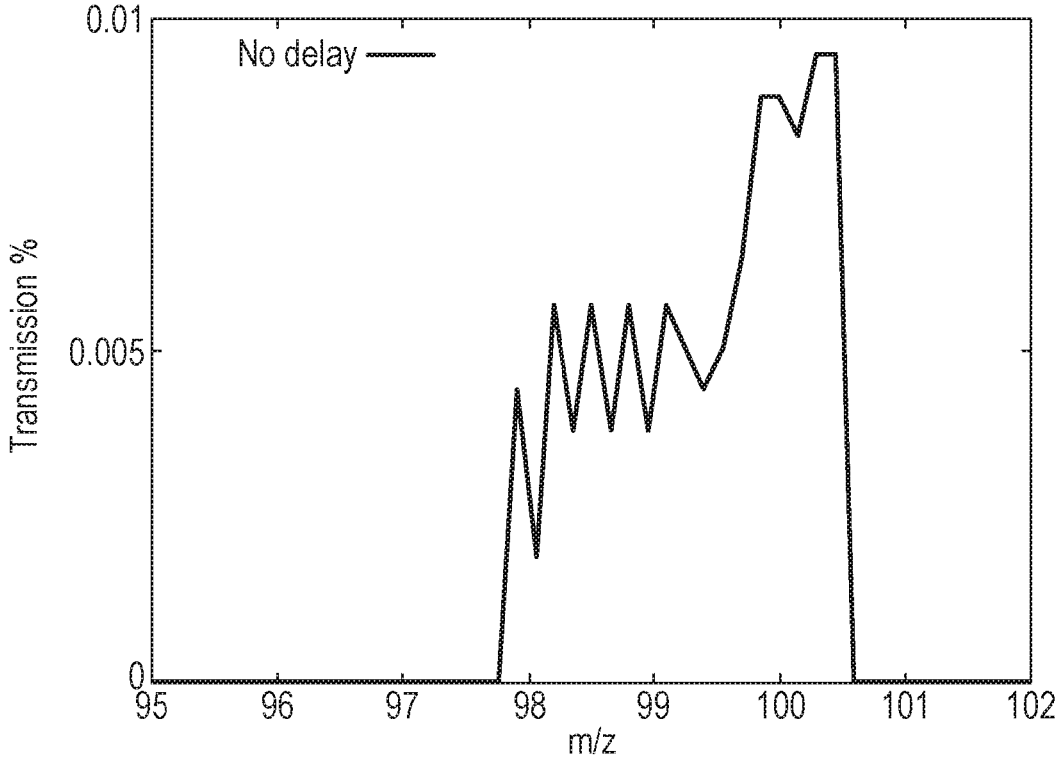
FIG. 2A shows simulated ion transmission data through a quadrupole where the quadrupole drive voltage is applied continuously.
Figure 2B:
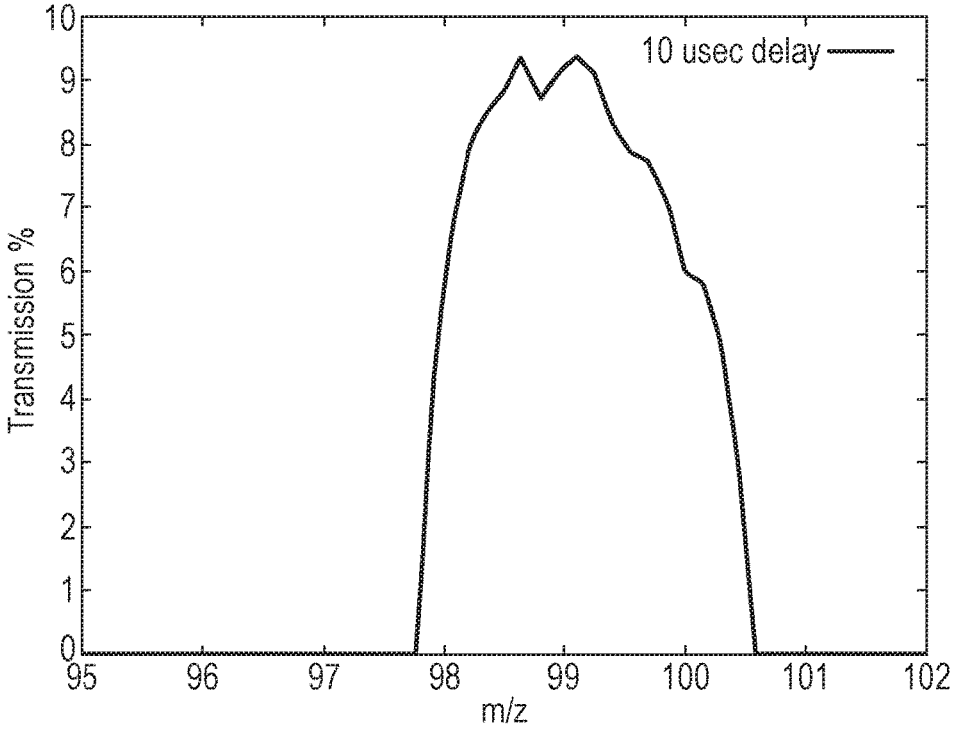
FIG. 2B shows simulated ion transmission data through a quadrupole utilising a 10 μs delay between releasing an ion packet into the quadrupole and applying the drive voltage.

FIG. 2 shows simulated ion transmission data as a function of mass to charge ratio ("m/z") for operation in the upper tip of the third stability region of a square wave driven quadrupole (tip q=2.335, a=2.749). FIG. 2A shows a simulated peak when the pulsed injection method according to various embodiments is not used, i.e. where the drive voltage is applied continuously, and FIG. 2B shows a simulated peak where the pulsed injection method according to various embodiments is used, in this case where a 10 μs delay is provided after a packet of ions is released before the drive voltage is applied to the quadrupole 3.

The simulations were performed assuming initial ion beam conditions corresponding to a uniformly filled disc with a radius of 0.05 mm, with an axial distance from the quadrupole rods of 3 mm, a thermal energy of 100 K, and an axial kinetic energy of 1 eV. The system settings were simulated assuming a quadrupole field radius $r_0$ of 5.33 mm, an RF frequency of 1 MHz, and a rod length of 250 mm.

As can be seen from FIG. 2, the transmission is increased by around three orders of magnitude when the pulsed injection ion technique according to various embodiments is used. This demonstrates that the technique according to various embodiments beneficially improves the transmission of ions across the fringing field region.

According to various embodiments, the one or more drive voltages that are applied to the quadrupole (i.e. during the second mode of operation) comprise a repeating (RF) voltage waveform. Opposite phases of the voltage waveform may be applied to each of the opposing pairs of electrodes of the quadrupole 3, or the voltage waveform may be applied to one of the pairs of electrodes.

The Applicants have recognised that the point (in time) during a (single) cycle of the voltage waveform (that is, the phase) at which ions initially experience the quadrupolar field can have a strong effect on the transmission of ions through the quadrupole. This is because, in particular, the maximum amplitude of (radial, i.e. x and/or y direction) ion oscillation in the quadrupole (i.e. as the ions pass through the quadrupole) depends on the initial phase experienced by the ions.

Accordingly, by selecting (controlling) the initial phase of the voltage waveform that ions initially experience (i.e. in the second mode of operation), the maximum amplitude of ion oscillation can be controlled, e.g. can be reduced or minimised (e.g. relative to other possible values of initial phase), e.g. so as to reduce the number of ions that collide with the rods of the quadrupole, to thereby further increase ion transmission through the quadrupole.

Figure 3:
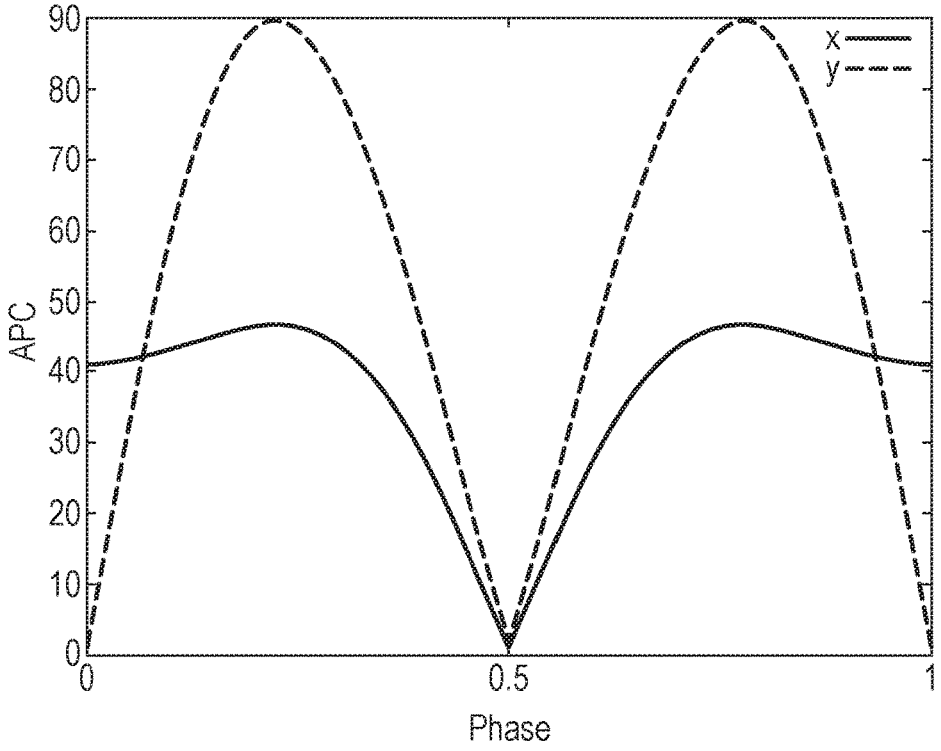
FIG. 3 shows a plot of the Amplitude Phase Characteristic ("APC") versus phase (in units of 2π), for a harmonic waveform, near the first stability region tip.
Figure 4:
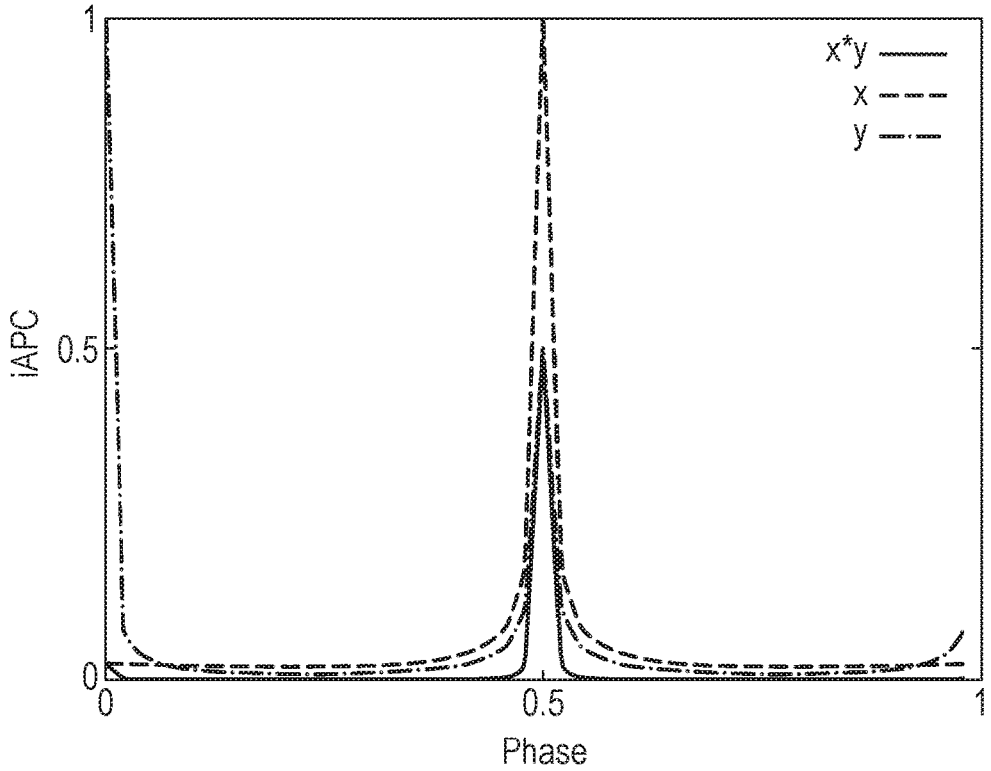
FIG. 4 shows a plot of the inverse Amplitude Phase Characteristic ("iAPC") versus phase, for a harmonic waveform, near the first stability region tip.

This is illustrated by FIGS. 3 and 4. As used herein, a first set of ion initial conditions, or "initial conditions of the first kind", are defined as x=1, and x'=0, i.e. the initial radial (x and/or y) position of ions within the quadrupole is non-zero while the initial radial velocity of ions within the quadrupole is zero. In addition, the Amplitude Phase Characteristic ("APC") of the first kind is defined as the maximum amplitude of ion oscillation of an ion of the first kind (i.e. having the first initial conditions) that is introduced into the quadrupole field at a given phase in the RF cycle. The APC is a property of the voltage waveform, the location in the q/a stability diagram, and the oscillation axis (x or y, as defined in FIG. 1).

FIG. 3 shows a numerical calculation of the APC in the x and y directions for a conventional harmonic RF waveform near the tip of the first stability region. The APC has units of the initial ion position, so, for example, in FIG. 3 the maximum ion oscillation in the y-axis has two maxima with respect to the initial input phase, with the maximum ion oscillation reaching about 90 times the initial y-axis position at these maxima.

Due to the large expansion of the ion packet at non-optimal phases, it can be clearer to plot the inverse APC ("iAPC"). This is shown in FIG. 4 for the same system as FIG. 3 (harmonic RF waveform with a stability working point (q/a) near the first stability region tip).

The iAPC shows the inverse of the maximum amplitude of ion oscillation, hence iAPC=1 corresponds to no expansion of the ion packet in that axis. The x×y trace is the product of the 2 axes (i.e. if iAPC(x)=0.5 and iAPC(y)=0.25 then the iAPC(xy)=0.125), which gives a measure of the overall iAPC for an ion packet with equal initial x and y dimensions.

FIG. 4 shows that there is a sharp peak in the iAPC(xy) at a fractional phase of 0.5. If ions are introduced to the quadrupole field at this phase, then the maximum oscillation amplitude of the ions is minimised with respect to their initial positions. This is beneficial since, although the location in the stability diagram means that all the ions are stable, those ions whose oscillation amplitude exceeds the inscribed radius (or "field radius") of the rods ($r_0$) will be lost due to striking the rods.

Ignoring the effect of initial velocity, if the oscillation amplitude is minimised with respect to initial ion position, higher acceptance for a given initial ion positional spread is observed. Thus, in the example in FIG. 4, higher mass filter transmission is observed if ions are introduced into the quadrupole field at an initial phase of 0.5, i.e. the maxima of the iAPC(xy). As used herein, this optimal phase is termed the "optimal phase of the first kind". In general, the "optimal phase" is a phase of the voltage waveform for which the maximum amplitude of ion oscillation is relatively reduced or minimised (e.g. relative to other phases), e.g. when ions initially experience that phase in the quadrupole mass filter.

Thus, according to various embodiments, the initial phase of the voltage waveform that ions initially experience is controlled, e.g. so as to control (reduce or minimise) the maximum amplitude of ion oscillation, e.g. so as to reduce the number of ions that collide with the rods of the quadrupole, to thereby increase transmission of ions through the quadrupole.

The point (in time) during the cycle of the voltage waveform (i.e. the phase) at which ions initially experience the quadrupolar field can be selected as desired. For example, the ions may initially experience the quadrupolar field at a phase of zero or greater than zero.

Where the voltage waveform comprises a harmonic waveform (and e.g. where the ions at least approximate to having the initial conditions of the first kind), then the initial phase of the waveform that ions initially experience may be controlled to be at or close to 0.5 (i.e. π radians). For example, the initial phase of the voltage waveform that ions initially experience may be controlled to be (i) ≥0.8π; (ii) ≥0.9π; (iii) ≥0.95π; (iv) ≥0.99π; or (v) ≥0.995π; and (i) ≤1.2π; (ii) ≤1.1π; (iii) ≤1.105π; (iv) ≤1.101π; or (v) ≤1.1005π radians.

According to various embodiments, the phase of the voltage waveform that ions initially experience may be controlled by controlling the time at which ions are introduced (injected) into the quadrupole.

However, injection of ions into a quadrupole at a specific time (phase value) can be challenging, e.g. due to the effects of the fringing fields and axial energy spread in the ion beam or packet.

The Applicants have recognised that, since according to various embodiments the drive voltage is reduced, removed and/or turned off when ions are introduced into the quadrupole (and then increased, applied, initiated or turned on at some later time), the initial phase at which the (digital) drive voltage is initially applied (i.e. initiated or turned on) can be freely selected.

Therefore, according to various embodiments, the appropriate initial phase of the drive voltage is selected (controlled), e.g. in order to maximise transmission or other performance characteristics of the mass filter. That is, according to various embodiments, the initial phase at which the drive voltage (the voltage waveform) is initiated is selected (controlled), i.e. the drive voltage is applied at a specific, pre-selected initial phase or range of phases, e.g. in order to ensure that the ions initially experience the optimal phase or close to the optimal phase, in order to maximise transmission or other performance characteristics of the mass filter.

As discussed above, the APC is a function of the applied waveform and stability working point location (q/a). FIG. 4 shows that the optimal phase for the harmonic first stability region tip is essentially a single value, and that the iAPC(xy) drops rapidly away from this phase.

The Applicants have recognised that other waveforms may be used, and moreover that this may be beneficial. In particular, the use of a digital drive in accordance with various embodiments can facilitate application of many different waveforms to the quadrupole.

Figure 5:
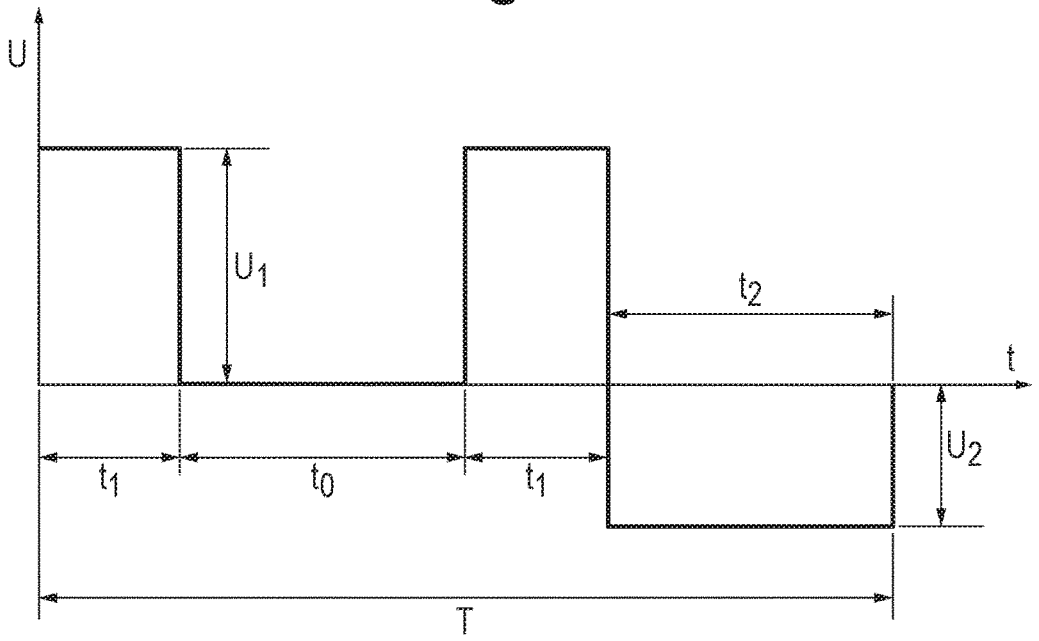
FIG. 5 shows a plot of the asymmetric pulse EC signal waveform.

FIG. 5 shows one such waveform that may be used in accordance with various embodiments, termed an "asymmetric pulsed EC signal". As shown in FIG. 5, in a single period T of the waveform, a first (positive) voltage $U_1$ is applied for time period $t_1$, zero volts is then applied for time period $t_0$, $U_1$ is applied again for time period $t_1$, then a second (negative) voltage $-U_2$ is applied for time $t_2$. It will be understood that this is a quadrupolar voltage, e.g. such that the waveform illustrated in FIG. 5 may be applied to one pair of opposing rod electrodes of the quadrupole, and an inverted version is applied to the other pair of rod electrodes. It would also be possible to apply the waveform to only one of the pairs of electrodes. Where the times $t_0$, $t_1$ and $t_2$ are set such that $t_1=T/6$, and $t_0=t_2=2T/6$, the waveform is termed the "N=6 waveform".

Figure 6:
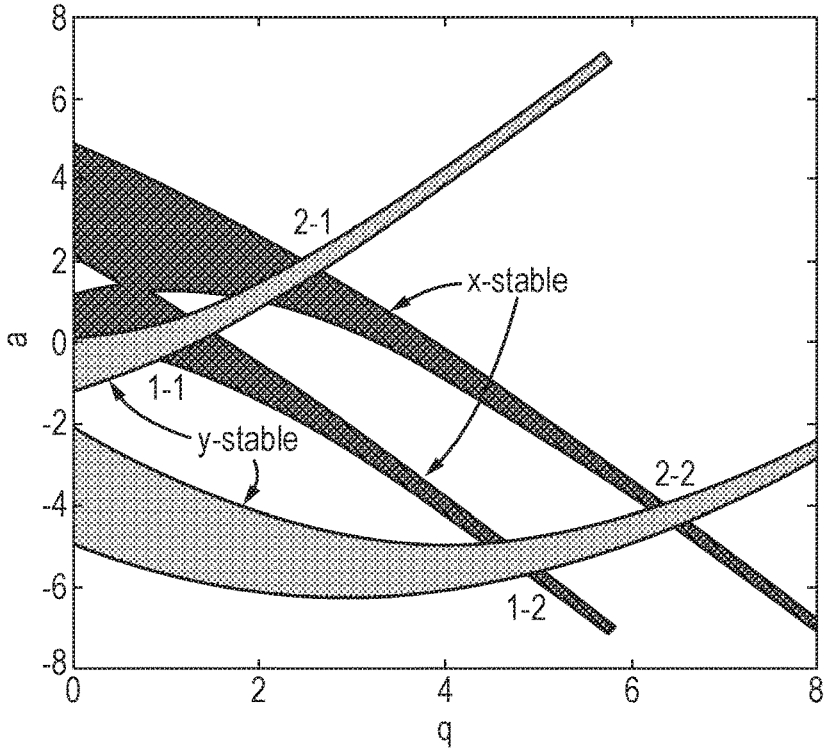
FIG. 6 shows the stability diagram for the pulsed EC N=6 waveform.

FIG. 6 shows the stability diagram for the asymmetric pulsed EC signal, where N=6. The stability regions are labelled according to the x-y band that they occupy, hence the usual first stable region is labelled 1-1 in this notation.

The stability parameters q and a used to plot the stability diagram of FIG. 6 are defined as:

$$q=fac\times 0.5\times(U_1-U_2), \text{ and}$$

$$a=fac\times(U_1+U_2),$$

where $U_1$ and $U_2$ are the two digital pulse amplitudes (defined in FIG. 5), $fac=4ze/(2\pi f)^2 r_0^2 m$, z is the number of charges on the ion, e is the elementary charge, f is the RF frequency, $r_0$ is the field radius of the quadruple, and m is the mass of the ion.

Figure 7:
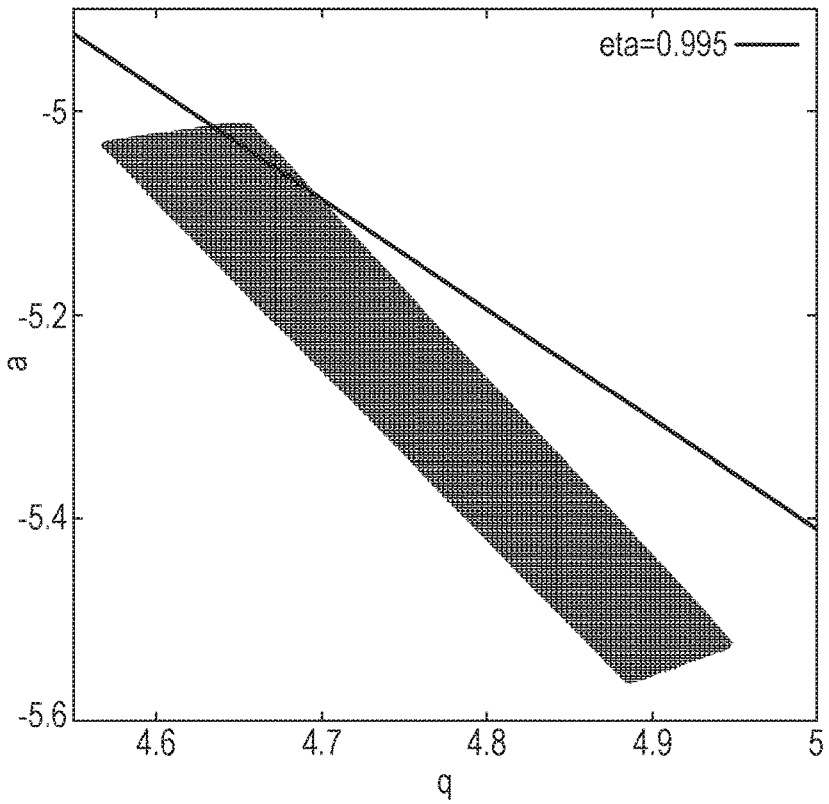
FIG. 7 shows a plot of the 1-2 stable region for the pulsed EC N=6 waveform, together with a scan line for the upper tip with a resolution of eta=0.995.

FIG. 7 shows a plot of the 1-2 stability region for the pulsed EC N=6 waveform, where only the area that is stable in both the x and y directions is shaded. Also shown is a typical scan line for operation as a scanning mass filter using the upper tip of this stability region. The resolution (i.e. how close the scan line is to the tip) is set by eta, where $a_{applied}=(2-eta)q_{applied}a_{tip}/q_{tip}$. In the plot of FIG. 7, eta=0.995.

Figure 8:
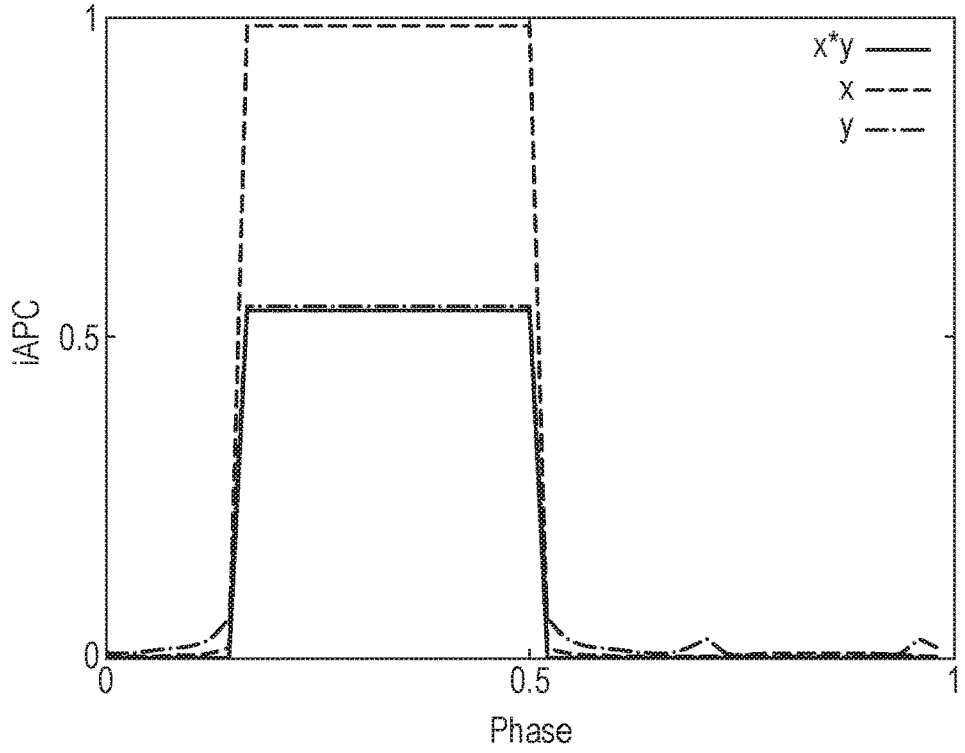
FIG. 8 shows a plot of the iAPC versus phase, for the pulsed EC N=6 waveform, for the upper tip of the 1-2 stability region.

FIG. 8 plots the iAPC for a point near the upper tip of the 1-2 region for the N=6 pulsed EC signal. FIG. 8 shows that there is a broad region of phase where the iAPC(xy)>0.5. Therefore, in order to obtain a high iAPC value, any phase value within this region may be chosen as the initial phase of the drive voltage.

It will be appreciated that this arrangement means that relatively high ion transmission can be achieved for a range of points (in time) during the cycle of the voltage waveform (i.e. a range of phases) at which ions initially experience the quadrupolar field. Correspondingly, relatively high ion transmission can be achieved for a range of initial phases at which the drive voltage is initiated. This can increase the overall ion transmission, e.g. since in practise it can be challenging to very precisely control the phase at which ions initially experience the quadrupolar field.

According to various embodiments, where the voltage waveform comprises a pulsed EC N=6 waveform, (and e.g. where the ions at least approximate to having the initial conditions of the first kind), then the initial phase of the waveform that ions initially experience may be controlled to be at or close to between ⅙ (i.e. $\pi/3$ radians) and ½ (i.e. $\pi$ radians). For example, the initial phase of the voltage waveform that ions initially experience may be controlled to be (i) $\geq 0.25\pi$ (ii) $\geq 0.3\pi$; (iii) $\geq 0.33\pi$; (iv) $\geq 0.35\pi$; or (v) $\geq 0.4\pi$; and (i) $\leq 1.1\pi$; (ii) $\leq 1.05\pi$; (iii) $\leq \pi$; (iv) $\leq 0.95\pi$; or (v) $\leq 0.9\pi$ radians.

Although the above embodiments have been described primarily in terms of using a pulsed EC N=6 waveform, it will be appreciated that many other waveforms may be used, e.g. to the same or similar effect.

In various embodiments, the voltage waveform that is applied to the quadrupole 3 may be selected such that the inverse Amplitude Phase Characteristic ("iAPC(xy)") is relatively large (i.e. such that the maximum amplitude of ion oscillation is relatively small) for a relatively high proportion of each cycle of the waveform. In this context, a relatively large iAPC(xy) may be, for example, (i) ≥0.1, (ii) ≥0.2, (iii) ≥0.3, (iv) ≥0.4, (v) ≥0.45, (vi) ≥0.5, (vii) ≥0.55, (viii) ≥0.6, (ix) ≥0.7, (x) ≥0.8, and/or (xi) ≥0.9. A relatively high proportion of each cycle of the waveform may comprise, for example, (i) at least 1%, (ii) at least 5%, (iii) at least 10%, (iv) at least 20%, (v) at least 30%, (vi) at least 40%, and/or (vii) at least 50% of the waveform period.

Configuring the voltage waveform in this manner means that the drive voltage can be initiated at some relatively wide range of initial phases, i.e. so that high transmission can be achieved more consistently and conveniently, thereby increasing the overall ion transmission.

As can also be seen by comparing FIGS. 5 and 8, for the pulsed EC N=6 waveform, the applied voltage is at zero for the entire optimal phase region (i.e. for the region of phase where the iAPC(xy)>0.5).

This is beneficial as this means that where the quadrupole is operated in the first mode of operation with the drive voltage turned off (with zero volts applied), the drive voltage can be (precisely) initiated at the desired initial phase, since the drive voltage at the desired initial phase is in this case zero volts. In other words, this guarantees the correct pulse voltage value at the optimal phase point in the waveform, where the ion packet is pulsed into the quadrupole with the drive voltage at zero. This is beneficial, e.g. compared to a waveform or initial phase combination where it is necessary to pulse the voltage instantaneously to some exact value, e.g. since this can be challenging in terms of electronics, etc.

Therefore, according to various embodiments, the voltage waveform is configured (selected) so as to have at least one portion (i.e. at least some phase values or (continuous) phase value range) where the applied drive voltage is zero.

The waveform may be configured (selected) such that the optimal phase (e.g. of the first kind) falls within such a portion (phase value), e.g. may be selected to have a stability working point where the optimal phase (e.g. of the first kind) falls within such a portion.

In other words, the optimal phase or range of phases may at least partially coincide with (be equal to) at least some phase values of the voltage waveform at which the drive voltage is zero. That is, the one or more drive voltages may be configured such that the maximum amplitude of ion oscillation is relatively reduced or minimised (e.g. relative to other possible phases) for one or more phases or ranges of phases of the voltage waveform that at least partially coincide with (are equal to) one or more phases at which the drive voltage is zero.

The APC and iAPC of the first kind are useful as they are indicative of the acceptance of the mass filter with respect to the initial positional spread of ions. They may be obtained from numerical simulations of the maximum amplitude obtained by ions of the first kind, i.e. ions with an initial positional spread but zero velocity in a given radial (x or y) axis.

Accordingly, if the injected ion packet is tuned (controlled) to have minimal radial velocity, the iAPC can be used to determine the maximum ion oscillation amplitude of the injected ion packet.

For the pulsed EC N=6 region 1-2 upper tip iAPC shown in FIG. 8, assuming that ions are injected in the optimal phase region, with zero radial velocity, and assuming that the initial ion disc radius is less than half the inscribed radius of the rods ($r_0$), 100% of ions will be accepted and stable in the mass filter. This property is true no matter how high the resolution is set, i.e. how closely the stability region tip is approached.

Figure 9:
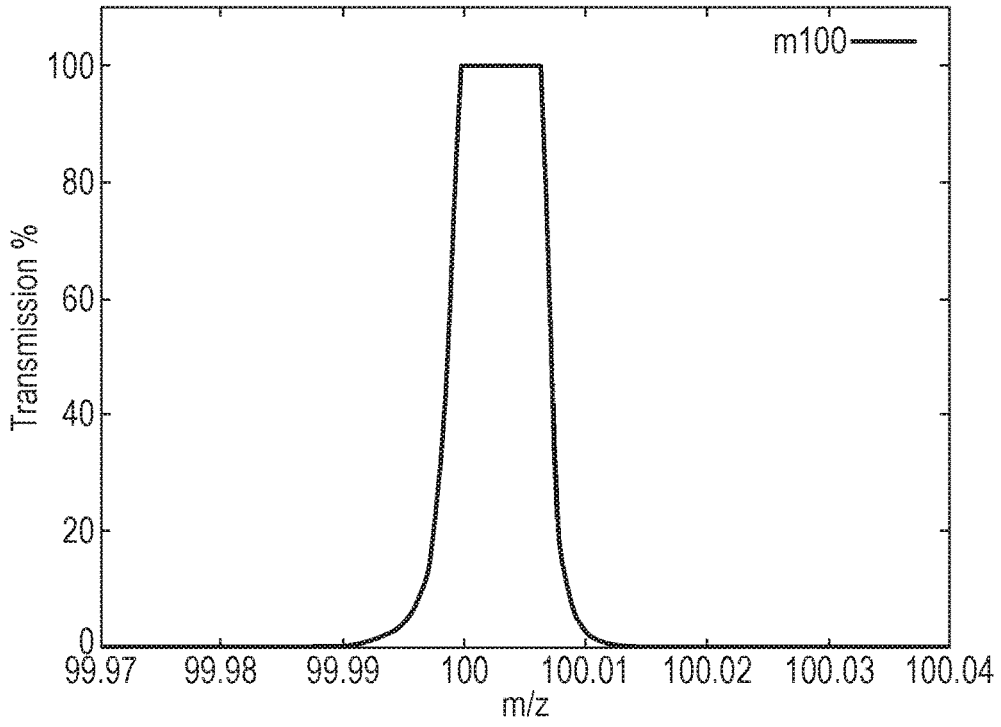
FIG. 9 shows simulated ion transmission data for a peak with m/z=100, for the pulsed EC N=6 signal, for the upper tip of the 1-2 stability region, where the initial phase is ⅓.

FIG. 9 plots simulated transmission through a quadrupole mass filter of an ion peak having a mass to charge ratio ("m/z") of 100, using a pulsed EC N=6 waveform, the upper tip of stability region 1-2, where eta=0.99998, $r_0$=2.66 mm, the quadrupole rod length is 100 mm, the initial axial kinetic energy is 0.1 eV, the input ion disc radius is 0.75 mm, the initial x and/or y velocity is zero, and the initial phase is ⅓. The initial phase chosen here falls within the optimal region (see FIG. 8), and it can therefore be seen that 100% of the ion packet is transmitted, despite the high resolution setting of the scan line (FWHM~0.01 Da for approximate resolution (m/Δm) 10,000).

Therefore according to various embodiments, ions are (an ion packet is) injected into the quadrupole with minimised radial velocity components. According to various embodiments ions are injected into the quadrupole such that they experience an initial optimal phase, e.g. of an appropriate voltage waveform and/or stability tip location of the mass filter.

As discussed above, the particular waveform chosen here (asymmetric pulsed EC N=6, upper tip region 1-2) is one of a multitude of possible waveform and/or stability tip combinations that lead to an optimal phase with a high iAPC value that may be used in accordance with various embodiments.

According to various embodiments, the pulsed injection (e.g. at zero drive voltage) method described herein may be used together with some upstream ion optical components, e.g. that may be arranged so as to expand the positional extent of the ion beam or ion packet in the radial direction(s) (in the x and/or y directions). That is, a "beam expander" may be provided, e.g. upstream of the quadrupole mass filter, and downstream of the ion source, and where present, the ion trap or trapping region. A beam expander may comprise a system of electrostatic lenses, but is not limited to this configuration.

As is known from Liouville's theorem, the total phase space of a system is conserved. For an ion beam with positional spread px and velocity spread vx in the x-axis, the product or phase space area px×vx is constant. Therefore, a beam expander is in various embodiments used to increase the positional spread and decrease the velocity spread.

If the drive voltage is activated at an optimal phase of the APC1 (as described above) the maximum ion oscillation amplitude is minimised with respect to the initial positional spread. Therefore, it is beneficial to increase the positional spread, e.g. if as a consequence it allows the velocity spread of the ion packet to be decreased.

Thus, according to various embodiments, the ion beam or ion packet may be radially expanded, e.g. using a beam expander, upstream of the quadrupole.

According to various further embodiments, a second set of initial conditions, or the "initial conditions of the second kind" may be defined as x=0, and x'=1, i.e. the initial radial position of ions with the quadrupole may be zero while the initial radial velocity of ions is non-zero.

In a corresponding manner to that described above, according to various embodiments, the drive voltage can be applied or activated at an optimal phase of the second kind.

Figure 10:
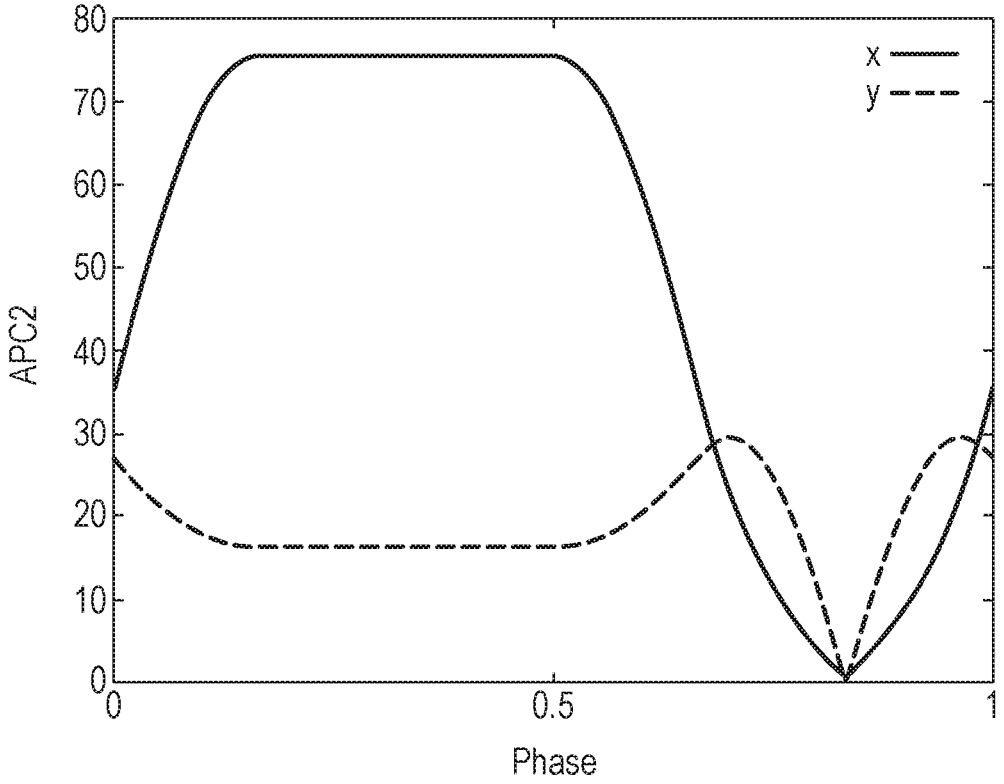
FIG. 10 shows a plot of the APC of the second kind versus phase, for the pulsed EC N=6 waveform, for the upper tip of the 1-2 stability region.

FIG. 10 shows a plot of the APC of the second kind ("APC2") (i.e. the APC for ions having the second initial conditions) versus phase for the pulsed EC N=6 waveform, near the upper tip of the 1-2 stable region. In this plot the APC2 is the maximum oscillation amplitude (in mm) where the initial ion velocity in each axis is 1000 m/s (the maximum oscillation amplitude scaling is linear with initial velocity). As can be seen from FIG. 10, there is an optimal phase of the second kind located at a phase value of 5/6.

If the drive voltage is activated at an optimal phase of the second kind, the maximum ion oscillation with respect to the initial ion velocity components is minimised.

Thus, according to various embodiments, where the voltage waveform comprises a pulsed EC N=6 waveform, (and e.g. where the ions at least approximate to having the initial conditions of the second kind), then the initial phase of the waveform that ions initially experience may be controlled to be at or close to 5/6 (i.e. $5\pi/3$ radians). For example, the initial phase of the voltage waveform that ions initially experience may be controlled to be (i) $\geq 1.6\pi$ (ii) $\geq 1.62\pi$; (iii) $\geq 1.64\pi$; or (iv) $\geq 1.66\pi$; and (i) $\leq 1.67\pi$; (ii) $\leq 1.68\pi$; (iii) $\leq 1.69\pi$; or (iv) $\leq 1.7\pi$ radians.

Although the above embodiments have been described primarily in terms of using a pulsed EC N=6 waveform, it will be appreciated that many other waveforms may be used, e.g. to the same or similar effect.

As described above, in various embodiments, the voltage waveform that is applied to the quadrupole 3 may be selected such that the inverse Amplitude Phase Characteristic ("iAPC(xy)") is relatively large (i.e. such that the maximum amplitude of ion oscillation is relatively small) for a relatively high proportion of each cycle of the waveform. According to various embodiments, the voltage waveform is configured (selected) so as to have at least one portion (i.e. at least some phase values or (continuous) phase value range) where the applied drive voltage is zero. The waveform may be configured (selected) such that the optimal phase (e.g. of the second kind) falls within such a portion (phase value), e.g. may be selected to have a stability working point where the optimal phase (e.g. of the second kind) falls within such a portion.

According to various embodiments, the initial ion positional spread may be minimised, e.g. at the cost of an increase in the velocity spread. This may be done, for example, by focusing the ion beam or ion packet, and e.g. timing the voltage pulse to activate as the ion packet reaches the focal position.

According to various further embodiments, where the ions at least approximate to having one or more other initial conditions, such as having both non-zero initial radial positions and non-zero initial radial velocities, then the one or more drive voltages (e.g. voltage waveform) may be configured in a corresponding manner to that described above, and the drive voltage can be applied or activated at an optimal phase.

It will accordingly be appreciated that various embodiments are directed to an improved quadrupole mass filter comprising a quadrupole mass filter with a digitally driven RF, and an ion trapping region upstream of the quadrupole mass filter.

In operation, the digital drive voltage applied to the quadrupole mass filter may be turned off, and ions may be released in a packet from the trapping region into the quadrupole mass filter. After some delay time the digital drive voltage may be applied to the quadrupole mass filter. Once all the ions having a mass to charge ratio ("m/z") of interest have passed through the quadrupole mass filter, the digital drive voltage may be returned to the off state, e.g. ready for another packet.

Ions may be accumulated in the trapping region between packet releases. This has the effect of increasing duty cycle.

The drive voltage may be applied at a specific, selected initial phase or range of phases (e.g. as described above).

The packet of ions may be injected into the quadrupole mass filter with minimal or zero radial velocity, i.e. velocity in the direction of the x and y axes.

The drive voltage may be applied at an initial phase that corresponds to an optimum in the inverse amplitude phase characteristic of the first kind ("iAPC1") of the waveform/stability working point location chosen.

The RF waveform may be chosen such that the waveform has at least one period in the RF cycle where the applied voltage is zero. The working point in the stability region may be chosen such that the optimal phase of the APC1 lies in this period.

Ion optical elements may be arranged between the trapping region and the quadrupole mass filter, e.g. to deliberately enlarge the radial positional extent of the ion beam or ion packet with a corresponding reduction in the radial velocity components.

The packet of ions may be injected such that at the point of application of the drive voltage the ion packet has minimal positional extent in the radial directions, i.e. along the x and/or y axes.

The drive voltage may be applied at an initial phase that corresponds to a minima in the amplitude phase characteristic of the second kind ("APC2") of the waveform and/or stability working point location chosen.

According to various embodiments, the quadrupole mass filter may be part of an analytical instrument such as a mass and/or ion mobility spectrometer. The analytical instrument may be configured in any suitable manner.

Figure 11:
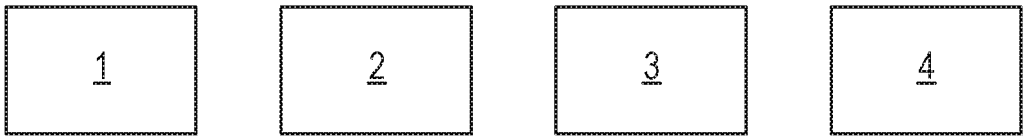
FIGS. 11-14 show schematically various analytical instruments comprising a quadrupole mass filter in accordance with various embodiments.

FIG. 11 shows an embodiment comprising an ion source 1, an ion accumulation region 2 downstream of the ion source 1, the quadrupole mass filter 3 downstream of the accumulation region 2, and a detector 4 downstream of the quadrupole 3.

Ions generated by the ion source 1 may be accumulated in the accumulation region 2. An accumulated packet of ions may be injected into the quadrupole mass filter 3 while the quadrupole drive voltage is turned off. This allows the ion packet to transit across the fringing field region of the quadrupole in a field-free state.

Once the packet of ions is at a sufficient axial distance into the quadrupole rod set, the drive voltages may then be applied (e.g. such that the field experienced by the ions is substantially identical to the 2D quadrupolar field, i.e. ions are far enough from the entrance of the quadrupole that fringing field effects are negligible). The initial phase may be selected to increase or maximise the retention of ions, e.g. as described above.

The drive voltage may cause ions to be radially confined within the quadrupole and/or to be selected or filtered according to their mass to charge ratio, e.g. as they pass through the quadrupole mass filter 3. Ions that emerge from the quadrupole mass filter 3 may be detected by the detector 4.

According to various embodiments, fringing field effects are avoided when ions are injected into the quadrupole mass filter. This can be used to provide improved resolution and transmission for the quadrupole mass filter.

Figure 12:
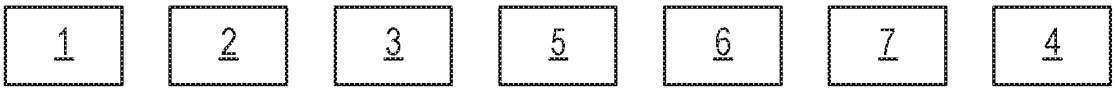

FIG. 12 shows a tandem quadrupole arrangement comprising a CID cell or other fragmentation device 5 downstream of the quadrupole mass filter 3, a second accumulation region 6 downstream of the fragmentation device 5, and a second quadrupole 7 downstream of the a second accumulation region 6. In various embodiments, both quadrupoles may be operated in a pulsed ion packet manner as described above, and trapping and release of ions in the first accumulation region 2 may be synchronised with trapping and release of ions in the second accumulation region 6 thereby accounting for the ion transit times between these regions.

Figure 13:
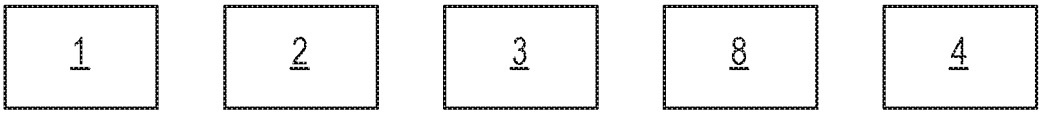

FIG. 13 shows a Quadrupole-Time-of-Flight ("Q-TOF") embodiment, comprising an orthogonal acceleration time of flight mass analyser 8 between the quadrupole mass filter 3 and the detector 4, which may be operated as described above.

According to various embodiments, ions may be stored in the accumulation region prior to release as packets into the quadrupole mass filter 3.

For a high incoming ion current, there may be issues with over-filling of the accumulation region. Space charge effects from the trapped ions may lead to a reduction in performance of the subsequent quadrupole mass filter (e.g. due to phase space expansion), or ion losses in the accumulation region itself leading to reduced sensitivity and/or mass discrimination effects.

Figure 14:
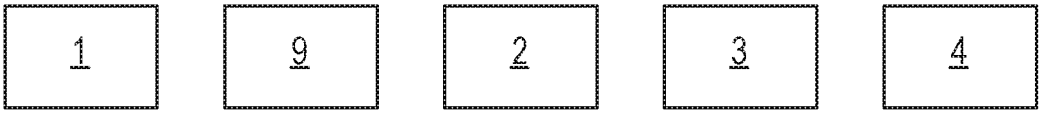

FIG. 14 shows an embodiment where a filter 9 is positioned before the accumulation region 2. The analytical instrument may be operated as described above, where the filter 9 may be used to control the level of charge in the accumulation region 2. Examples of filters in accordance with various embodiments include quadrupole mass filters, ion mobility devices, differential mobility analysis ("DMA") devices, field asymmetric-waveform ion-mobility spectrometry ("FAIMS") devices, differential mobility spectrometry ("DMS") devices, thermal ionisation mass spectrometry ("TIMS") devices, and the like.

According to various embodiments, the quadrupole mass filter as disclosed herein may be operated in other configurations, e.g. with different analysers or ion separators (for example an ion mobility separator) or dissociation devices upstream or downstream of the quadrupole mass filter or filters.

Although the above embodiments have been described primarily in terms of applying a (single) quadrupolar voltage to the quadrupole device, it would also be possible to apply one or more additional quadrupolar and/or dipolar voltages to the quadrupole device.

As such, the one or more drive voltages (and the repeating voltage waveform) may comprise one or more quadrupolar repeating voltage waveforms, optionally together with one or more dipolar repeating voltage waveforms.

A quadrupolar repeating voltage waveform may be applied to the quadrupole device by applying the same phase of the repeating voltage waveform to opposing electrodes of the quadrupole device, and by applying opposite phases of the repeating voltage waveform to adjacent electrodes (e.g. as described above). A dipolar repeating voltage waveform may be applied to the quadrupole device by applying opposite phases of the repeating voltage waveform to (one or both) opposing pairs of electrodes of the quadrupole device (and optionally by applying the same phase of the repeating voltage waveform to pairs of adjacent electrodes).

The amplitude and/or frequency of the one or more additional quadrupolar and/or dipolar voltages may be selected as desired.

According to various embodiments, the one or more additional quadrupolar and/or dipolar voltages may have the effect of altering the stability diagram, e.g. so as to add bands of instability. The previous stable region(s) may be bisected by the bands of instability. This may lead to the (previously) stable regions splitting into multiple smaller stable regions, i.e. numerous smaller "islands of stability".

The Applicants have found that there are benefits, e.g. in terms of the peak shape and/or speed of ion ejection, associated with operating the quadrupole device within such stability islands (e.g. that may be formed from the former first stability region or higher order stability regions).

Thus, according to various embodiments, the quadrupole device is operated as described above, but when the quadrupolar RF voltage waveform is applied to the quadrupole device, one or more additional quadrupolar and/or dipolar waveforms are also applied. 15 Aug. 2017

Figure 15A:
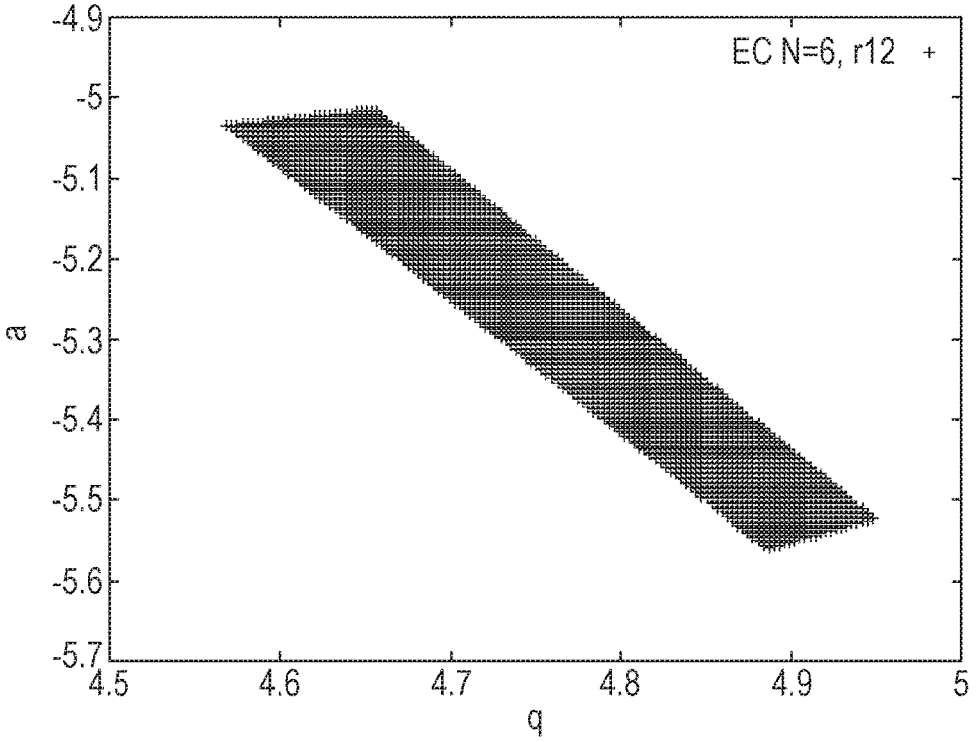
FIG. 15A shows a plot of the 1-2 stable region for the pulsed EC N=6 waveform.
Figure 15B:
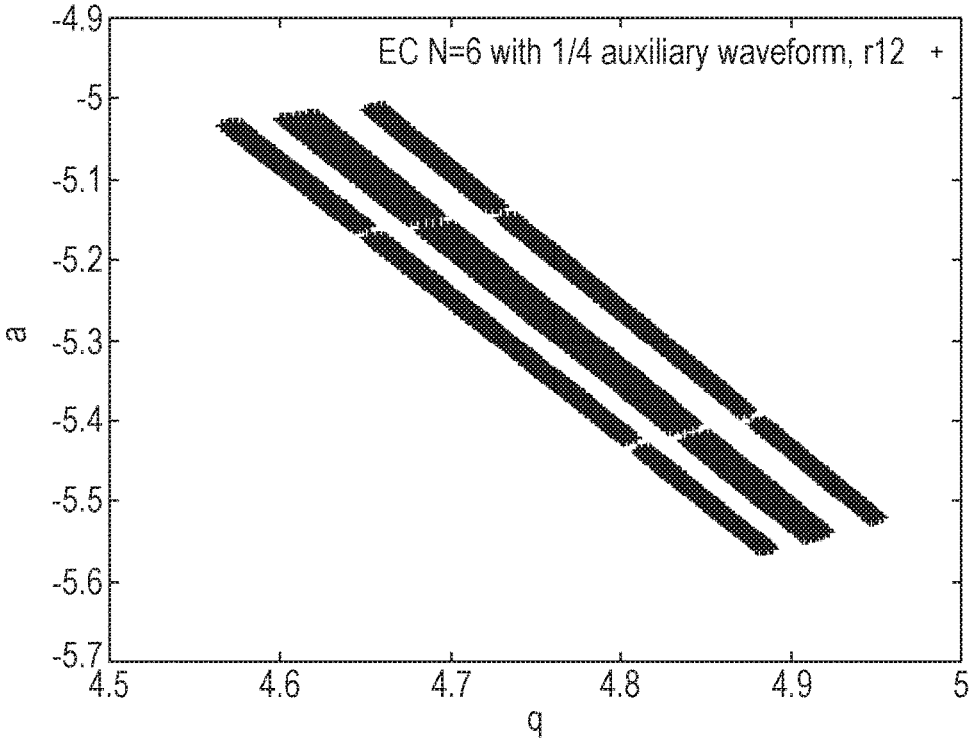
FIG. 15B shows a plot of the same stable region where an additional RF waveform with a frequency of ¼ of the main waveform frequency is applied (voltage amplitude=0.01 q).

FIG. 15A shows the 1-2 stability region for a pulsed EC N=6 waveform (as shown in FIG. 7). FIG. 15B shows the same stability region when an additional RF waveform with a frequency of ¼ of the main waveform frequency (voltage amplitude=0.01 q) is applied. It can be seen that the previous stability region (shown in FIG. 15A) is split into multiple smaller stability regions.

According to various embodiments, the device may be operated in the manner described above while using a scan line that cuts across the tip of one of these islands of stability.

Additional dipolar excitations may also or instead be used to cause modification(s) to the stability diagram. When an additional dipolar waveform is applied, bands of instability are added in one axis (x or y) only. Calculation of stability diagrams for systems with dipolar excitation is not formally possible as the field is no longer purely quadrupolar. However numerical methods can be used to generate an "effective" stability diagram.

Thus, according to various embodiments, the main RF waveform is supplemented with one or more additional quadrupolar and/or dipolar waveforms. The one or more additional quadrupolar and/or dipolar waveforms may have the effect of introducing one or more instability bands into the stability diagram.

Although the above embodiments have been described primarily in terms of applying a digital drive voltage, according to various embodiments, the techniques described herein may be used with a resonantly driven quadrupole, e.g. where one or more RF voltages together with one or more DC offset voltages are applied to the electrodes of the quadrupole device.

Although the above embodiments have been described primarily in terms of injecting packets of ions into a quadrupole, according to various embodiments, the quadrupole may be illuminated with a continuous ion beam, e.g. with a corresponding reduction in duty cycle.

Although the above embodiments have been described primarily in terms of the operation of a quadrupole mass filter, the techniques described herein may be applied to the of operation of a linear (2D) ion trap.

In these embodiments, the linear ion trap may comprise four rod electrodes, which may be arranged parallel to one another (e.g. as illustrated in FIG. 1, and as described above), together with two (or more) end electrodes, e.g. at either (axial) end of the quadrupole arrangement. In the second mode of operation, one or more drive voltages may be applied to the rod electrodes such that ions are radially confined within the linear ion trap (e.g. in the manner described above) (and in the first mode of operation one or more reduced drive voltages may be applied or no drive voltage may be applied to the rod electrodes, e.g. as described above).

In addition, in these embodiments, in the second mode of operation, one or more DC voltages may be applied to the end electrodes such that ions are axially confined within the linear ion trap, and in the first mode of operation one or more reduced DC voltages may be applied (or no DC voltage may be applied) to one or both of the end electrodes.

Although the present invention has been described with reference to preferred embodiments, it will be understood by those skilled in the art that various changes in form and detail may be made without departing from the scope of the invention as set forth in the accompanying claims.

The invention claimed is:

1. A method of operating a quadrupole device comprising:

operating the quadrupole device in a first mode of operation;

passing ions into the quadrupole device while the quadrupole device is operated in the first mode of operation; and then operating the quadrupole device in a second mode of operation;

wherein operating the quadrupole device in the second mode of operation comprises applying one or more drive voltages to the quadrupole device, wherein the one or more drive voltages comprise a repeating voltage waveform, and wherein operating the quadrupole device in the second mode of operation comprises initially applying the one or more drive voltages to the quadrupole device at a selected phase or range of phases of the voltage waveform;

wherein operating the quadrupole device in the first mode of operation comprises applying one or more reduced drive voltages or not applying one or more drive voltages to the quadrupole device; and wherein the voltage waveform is configured to have a continuous phase value range at which the drive voltage is zero, and wherein the selected phase or range of phases coincides with the continuous phase value range at which the drive voltage is zero.

2. A method as claimed in claim 1, wherein passing ions into the quadrupole device comprises passing one or more packets of ions into the quadrupole device.

3. A method as claimed in claim 1, wherein the one or more drive voltages comprises one or more digital drive voltages.

4. A method as claimed in claim 1, wherein:

the method comprises operating the quadrupole device such that the ions initially experience the selected phase or range of phases of the voltage waveform in the quadrupole device.

5. A method as claimed in claim 1, wherein the selected phase or range of phases comprises or is close to an optimal phase or range of phases such that the amplitude of ion oscillation is reduced or minimised.

6. A method as claimed in claim 1, further comprising:

increasing the radial positions of at least some of the ions and/or reducing the radial velocities of at least some of the ions before passing the ions into the quadrupole device; or decreasing the radial positions of at least some of the ions and/or increasing the radial velocities of at least some of the ions before passing the ions into the quadrupole device.

7. A method as claimed in claim 1, wherein:

the quadrupole device comprises a quadrupole mass filter, and wherein operating the quadrupole device in the second mode of operation comprises applying one or more drive voltages to the quadrupole mass filter such that ions are selected and/or filtered according to their mass to charge ratio; or the quadrupole device comprises a linear ion trap, and wherein operating the quadrupole device in the second mode of operation comprises applying one or more drive voltages to the linear ion trap such that ions are radially confined within the linear ion trap.

8. A method as claimed in claim 1, wherein operating the quadrupole device in the first mode of operation comprises applying a zero drive voltage or not applying a drive voltage to the quadrupole device.

9. A method as claimed in claim 1, wherein the one or more drive voltages comprise one or more quadrupolar repeating voltage waveforms, optionally together with one or more dipolar repeating voltage waveforms.

10. Apparatus comprising:

a quadrupole device; and a control system;

wherein the control system is configured:

(i) to operate the quadrupole device in a first mode of operation;

(ii) to cause ions to be passed into the quadrupole device while the quadrupole device is operated in the first mode of operation; and then (iii) to operate the quadrupole device in a second mode of operation;

wherein the control system is configured to operate the quadrupole device in the second mode of operation by applying one or more drive voltages to the quadrupole device, wherein the one or more drive voltages comprise a repeating voltage waveform, and wherein the control system is configured to operate the quadrupole device in the second mode of operation by initially applying the one or more drive voltages to the quadrupole device at a selected phase or range of phases of the voltage waveform;

wherein the control system is configured to operate the quadrupole device in the first mode of operation by applying one or more reduced drive voltages or by not applying one or more drive voltages to the quadrupole device; and wherein the voltage waveform is configured to have a continuous phase value range at which the drive voltage is zero, and wherein the selected phase or range of phases coincides with the continuous phase value range at which the drive voltage is zero.

11. Apparatus as claimed in claim 10, further comprising:

an ion trap or trapping region;

wherein the control system is configured to cause one or more packets of ions to be passed from the ion trap or trapping region into the quadrupole device.

12. Apparatus as claimed in claim 10, wherein:

the control system is configured to operate such that the ions initially experience the selected phase or range of phases of the voltage waveform in the quadrupole device.

13. Apparatus as claimed in claim 10, wherein the selected phase or range of phases comprises or is close to an optimal phase or range of phases such that the amplitude of ion oscillation is reduced or minimised.

14. Apparatus as claimed in claim 10, wherein the quadrupole device comprises a quadrupole mass filter, and wherein the control system is configured to operate the quadrupole device in the second mode of operation by applying one or more drive voltages to the quadrupole mass filter such that ions are selected and/or filtered according to their mass to charge ratio; or wherein the quadrupole device comprises a linear ion trap, and wherein the control system is configured to operate the quadrupole device in the second mode of operation by applying one or more drive voltages to the linear ion trap such that ions are radially confined within the linear ion trap.

* * * * *